US011092109B2

(12) United States Patent
Park et al.

(10) Patent No.: US 11,092,109 B2
(45) Date of Patent: Aug. 17, 2021

(54) BLOCK INSERT AND CYLINDER STRUCTURE OF VEHICLE ENGINE INCLUDING THE SAME

(71) Applicants: HYUNDAI MOTOR COMPANY, Seoul (KR); KIA MOTORS CORPORATION, Seoul (KR)

(72) Inventors: Cheol-Soo Park, Yongin-si (KR); Jun-Sik Park, Seoul (KR); Chang-Joo Lee, Seoul (KR); Dong-Suk Chae, Hwaseong-si (KR); Min-Kyu Park, Yongin-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 28 days.

(21) Appl. No.: 16/688,016

(22) Filed: Nov. 19, 2019

(65) Prior Publication Data

US 2020/0256278 A1 Aug. 13, 2020

(30) Foreign Application Priority Data

Feb. 13, 2019 (KR) ..... 10-2019-0016678

(51) Int. Cl.
*F02F 1/14* (2006.01)
*F02F 1/10* (2006.01)

(52) U.S. Cl.
CPC ..... *F02F 1/10* (2013.01)

(58) Field of Classification Search
USPC ..... 123/41.01, 41.02, 41.08, 41.09, 41.17, 123/41.31, 41.44, 196 AB
See application file for complete search history.

(56) References Cited

U.S. PATENT DOCUMENTS 10,513,964 B2 * 12/2019 Lee ..... F02F 1/14
2002/0000210 A1 * 1/2002 Shinpo ..... F02F 7/007 123/41.74
2005/0217615 A1 * 10/2005 Matsutani ..... F01P 9/00 123/41.74
2005/0235930 A1 * 10/2005 Xin ..... F02F 1/108 123/41.74
2010/0031902 A1 * 2/2010 Alyanak ..... F02F 1/14 123/41.44

(Continued)

FOREIGN PATENT DOCUMENTS

KR 10-1550981 9/2015
WO WO-2016104478 A1 * 6/2016 ..... F02F 1/14

*Primary Examiner* — George C Jin
*Assistant Examiner* — Teuta B Holbrook

(57) ABSTRACT

An engine structure includes a cylinder block, a cylinder liner, a block water jacket formed between the cylinder block and the cylinder liner, a block insert assembly inserted into the block water jacket, and an cylinder head. In particular, the block insert assembly includes: a first block insert and a second block insert, which are disposed between the cylinder liner and the cylinder block. One side end portion of the first block insert, which is adjacent to a block coolant inlet side, has a first flow resistor for sealing only a partial space of the space between the cylinder block and the cylinder liner, and one side end portion of the second block insert, which is adjacent to the block coolant inlet side, has a second flow resistor for sealing the entire space between the cylinder block and the cylinder liner.

16 Claims, 10 Drawing Sheets

(56) References Cited

U.S. PATENT DOCUMENTS

| | | | | |
|---|---|---|---|---|
| 2011/0114041 | A1* | 5/2011 | Hamakawa | F02F 1/14 123/41.72 |
| 2011/0132295 | A1* | 6/2011 | Hamakawa | F01P 7/14 123/41.74 |
| 2015/0136380 | A1 | 5/2015 | Kim | |
| 2016/0123216 | A1* | 5/2016 | Yoon | F01P 3/02 123/41.74 |
| 2016/0377023 | A1* | 12/2016 | Suh | F02F 1/14 123/41.79 |
| 2017/0167354 | A1* | 6/2017 | Park | F02F 1/14 |
| 2017/0370271 | A1* | 12/2017 | Lee | F02F 1/14 |
| 2019/0032595 | A1* | 1/2019 | Yoshimura | F01P 3/02 |
| 2019/0085750 | A1* | 3/2019 | Lee | F02F 1/14 |
| 2020/0018255 | A1* | 1/2020 | Fujita | F02F 1/40 |
| 2020/0063635 | A1* | 2/2020 | Fujita | F02F 1/14 |

* cited by examiner

BLOCK INSERT AND CYLINDER STRUCTURE OF VEHICLE ENGINE INCLUDING THE SAME

CROSS-REFERENCE TO RELATED APPLICATION

This application claims priority to and the benefit of Korean Patent Application No. 10-2019-0016678, filed on Feb. 13, 2019, the entire contents of which are incorporated herein by reference.

FIELD

The present disclosure relates to a block insert and a cylinder structure of a vehicle engine including the same.

BACKGROUND

The statements in this section merely provide background information related to the present disclosure and may not constitute prior art.

In a conventional engine, the temperature of the coolant of a cylinder head and a cylinder block is adjusted by one coolant temperature adjusting mechanism disposed at an engine inlet or an engine outlet. Therefore, the cylinder head and the cylinder block keep the coolant temperature almost similar to each other.

When the temperature of the wall surface of the cylinder block is increased, the fuel efficiency is improved due to reduced friction loss of a piston, however, when the entire engine temperature is increased, there is a problem in the combustion stability such as knocking. Therefore, it is desired to keep the temperature of the upper portion of the block at a relatively low temperature in order to enhance the combustion stability, while it is desired to keep the temperature of the lower portion of the block at a high temperature in order to reduce the friction of the piston.

As described in Korean Patent No. 10-1550981 (Sep. 7, 2015), a variable separation cooling technology for separately adjusting the coolant of the cylinder head and the cylinder block has been developed. Meanwhile, in order to apply the variable separation cooling technology, a structure for separating the coolant of the cylinder head side and the cylinder block should be formed. For this purpose, a water hole of a head gasket is generally removed. In this case, we have discovered that since the entire temperature of the cylinder block needs to be increased, it is difficult to reduce the temperature at the upper portion of the block. Furthermore, when a block temperature adjusting device fails, the coolant at the block side always stagnates, thereby resulting in the breakage of the entire engine.

In a so-called cross-flow method, coolant cross-flows from an exhaust side toward an intake side instead of a conventional parallel-flow method in which coolant flows into a water jacket of the cylinder block and head in parallel from the front of the engine toward the rear thereof. However, we have also found that there is a problem in that a coolant chamber for generating the cross-flow should be separately formed in the block of the conventional engine in order to apply such a cross-flow method.

The contents described in Description of Related Art are to help the understanding of the background of the present disclosure, and can include what is not previously known to those skilled in the art to which the present disclosure pertains.

SUMMARY

The present disclosure provides a block insert assembly and a cylinder structure of a vehicle engine, which can constitute the cross-flow even without separately constituting a coolant chamber in a block, and separately cooling the upper and lower portions of the block at low cost.

In one form, the present disclosure provides a block insert assembly mounted on a block water jacket for an engine, wherein the block water jacket is formed between a cylinder block and a cylinder liner, and of the block insert assembly comprising: a first block insert and a second block insert, which are arranged between the cylinder liner and the cylinder block. In particular, a first side end portion of the first block insert, which is adjacent to a block coolant inlet side, has a first flow resistor for sealing only a partial space of the space between the cylinder block and the cylinder liner, and a first side end portion of the second block insert, which is adjacent to the block coolant inlet side, has a second flow resistor for sealing the entire space between the cylinder block and the cylinder liner.

In one form, a second side end portion of the first block insert has a third flow resistor for sealing the entire space between the cylinder block and the cylinder liner, and a second side end portion of the second block insert has a fourth flow resistor for sealing only a partial space of the lower portion of the space between the cylinder block and the cylinder liner.

In another form, the first side end portion of the first block insert and the second side end portion of the second block insert are configured to be inclined downwardly from the upper portion of an insert frame that is a main body, respectively.

In order to block the flow of the coolant more reliably by the flow resistor, the flow resistors provided at the second side end portion of the first block insert and the first side end portion of the second block insert are protruded upwardly from the insert frame that is a main body of the block insert assembly, respectively.

Considering heat resistance, workability, etc., the block insert assembly is made of a resin material.

In order to reliably generate a warm block by increasing the lower temperature of the cylinder block, the inside surface of at least any one of the first block insert or the second block insert can be provided with at least one vertical rubber seal that is a flow resistor in the vertically extending and protruding shape. Then, in order to form the warm block more effectively, the vertical rubber seal is disposed at a position corresponding to an inter-bore of the cylinder block.

In order to generate the warm block by increasing the lower temperature of the cylinder block, and to facilitate the cooling of the upper portion of the cylinder block, the inside surface of at least one of the first block insert or the second block insert can be provided with at least one horizontal rubber seal that is a flow resistor in the horizontally extending and protruding shape. Then, in order to implement the above effects more reliably, the horizontal rubber seal may extend within a predetermined angle range from the left to the right based on a position corresponding the inter-bore of the cylinder block, which is a position having the highest temperature, when viewed from the upper surface thereof.

An engine structure of a vehicle according to one form of the present disclosure comprises: a cylinder block including a block coolant inlet through which coolant flows; and a block coolant outlet through which the coolant flows out; a cylinder liner arranged inside of the cylinder block, and formed with a plurality of cylinder bores; a block water jacket formed between the inner circumferential surface of the cylinder block and the outer circumferential surface of the cylinder liner, the coolant configured to flow along the block water jacket; a block insert assembly inserted into the block water jacket to guide the flow of the coolant in the block water jacket; and a cylinder head provided with a head water jacket receiving the coolant flowing in the block water jacket. In particular, the block insert assembly includes: a first block insert disposed on the exhaust side of the cylinder block and inserted between the cylinder liner and the cylinder block, and a second block insert disposed on the intake side of the cylinder block and inserted between the cylinder liner and the cylinder block, wherein a first side end portion of the first block insert, which is adjacent to a block coolant inlet side, has a first flow resistor for sealing only a partial space of the lower portion of the space between the cylinder block and the cylinder liner, and a first side end portion of the second block insert, which is adjacent to the block coolant inlet side, has a second flow resistor for sealing the entire space between the cylinder block and the cylinder liner, thereby guiding a part of the coolant received from the block coolant inlet to the head water jacket along the upper surface of the first flow resistor, and preventing by the second flow resistor a part of the coolant received from the block coolant inlet from directly flowing into the block water jacket of the side on which the second block insert is installed.

In one form, a second side end portion of the first block insert has a third flow resistor for sealing the entire space between the cylinder block and the cylinder liner, and a second side end portion of the second block insert has a fourth flow resistor for sealing only a partial space of the lower portion of the space between the cylinder block and the cylinder liner, thereby preventing by the third flow resistor the coolant from being directly discharged to the block coolant outlet from the second side end portion of the first block insert, and guiding the coolant to the block coolant outlet along the upper surface of the fourth flow resistor.

In an exemplary form, the inside surface of at least one of the first block insert or the second block insert is provided with at least one vertical rubber seal that is a flow resistor in the vertically extending and protruding shape.

In other form, the vertical rubber seal is disposed at a position corresponding to an inter-bore of the cylinder block.

In still other form, the inside surface of at least any one of the first block insert or the second block insert is provided with at least one horizontal rubber seal that is a flow resistor in the horizontally extending and protruding shape.

In another aspect of the present disclosure, a coolant drill hole that passes through the inter-bore of the cylinder block and obliquely extends downwardly from the upper portion of the cylinder block is formed in the cylinder block, and the horizontal rubber seal is disposed at the lower portion of both end portions of the coolant drill hole.

In other form, the horizontal rubber seal extends within a predetermined angle range from the left to the right based on a position corresponding to the inter-bore of the cylinder block.

According to the present disclosure, it is possible to use the block insert having the inexpensive rubber seal even without separately constituting the coolant chamber in the cylinder block, thereby implementing the cross-flow of the coolant at the time of cooling the engine.

According to the present disclosure, it is possible to efficiently stagnate the coolant at the lower portion of the block to increase the temperature of the lower portion of the block, thereby further reducing the friction of the piston than the related art.

In addition, according to the present disclosure, it is possible to improve the flow rate of the coolant at the upper portion of the block to reduce the temperature of the upper portion of the block, thereby improving the knocking characteristic and improving the output and the fuel efficiency in the low-medium speed and high load region.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
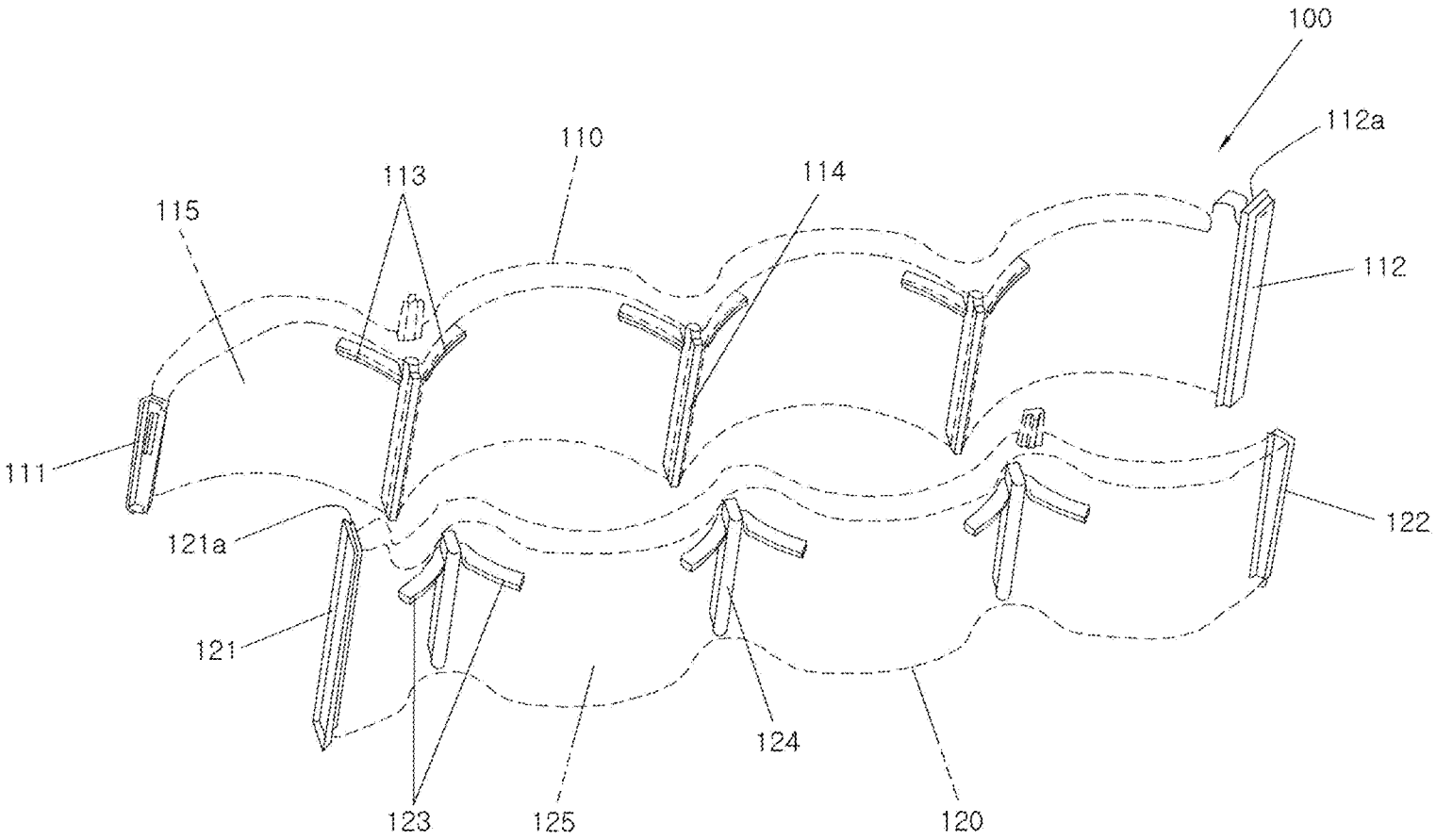
FIG. 1 is a perspective diagram of a block insert assembly according to one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

First, a cylinder structure of a vehicle engine according to one form of the present disclosure will be described with reference to FIGS. 6, 7A, and 7B, and then a block insert assembly according to an exemplary form of the present disclosure will be described with reference to FIGS. 1 to 5.

Figure 6:
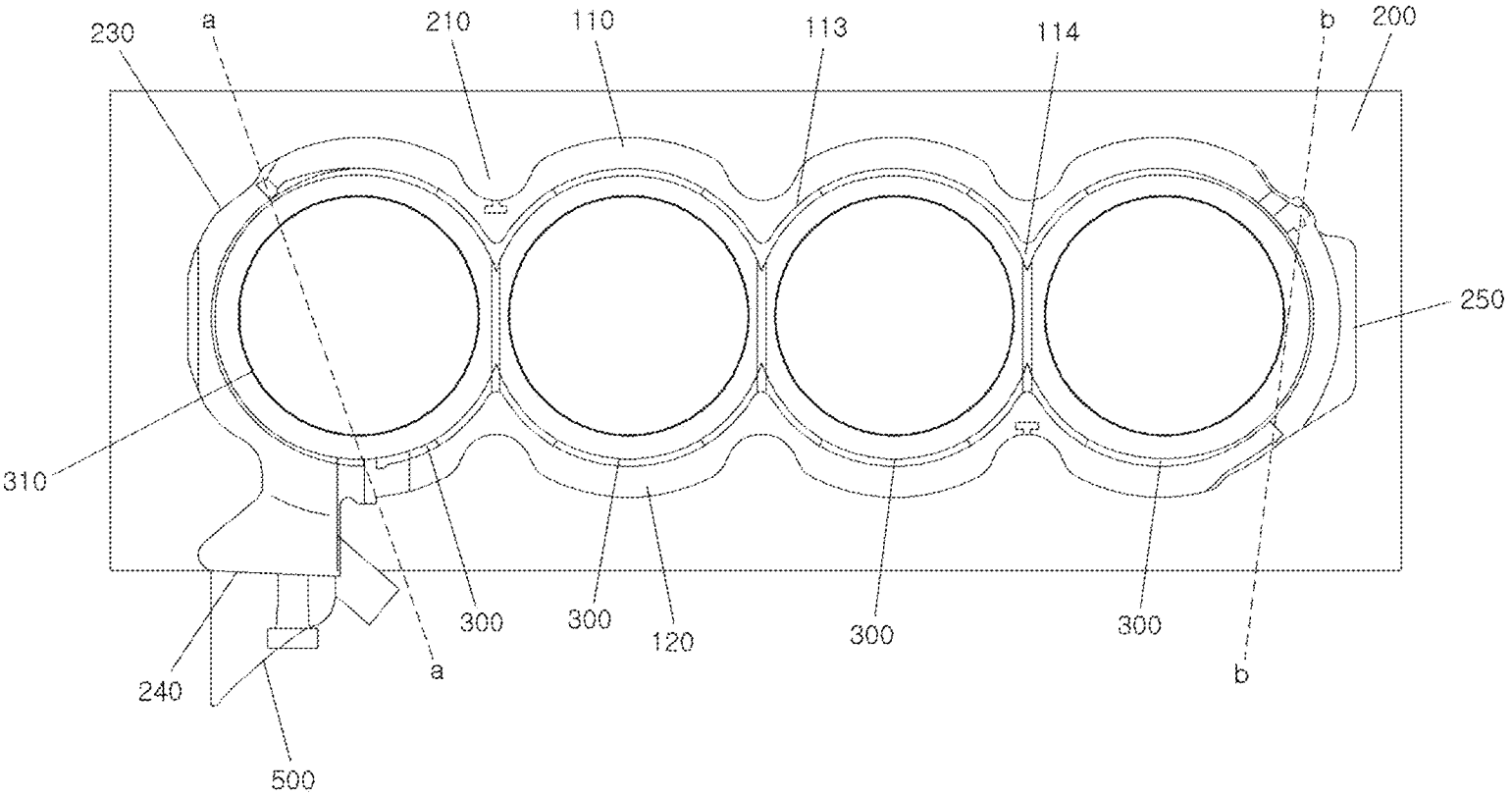
FIG. 6 is a plane diagram of a cylinder structure of a vehicle engine according to one form of the present disclosure.
Figure 7A:
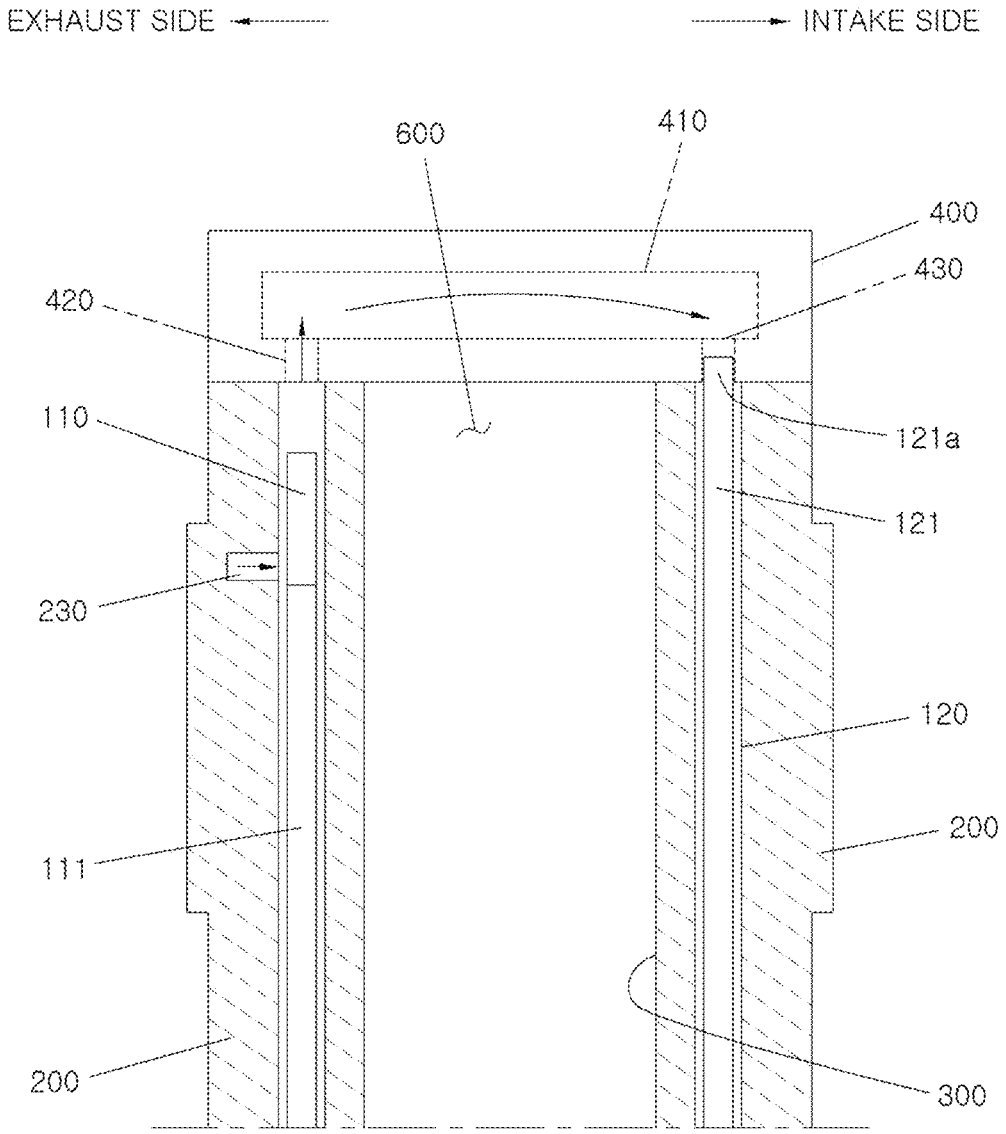
FIG. 7A is a cross-sectional diagram taken along the line a-a of FIG. 6.

FIG. 6 is a plane diagram of a cylinder structure of a vehicle engine according to the present disclosure. FIG. 7A is a cross-sectional diagram taken along the line a-a of FIG. 6 when viewed from the front side of the vehicle, and FIG. 7B is a cross-sectional diagram taken along the line b-b in FIG. 6 when viewed from the rear side of the vehicle.

A cylinder structure of a vehicle engine according to the present disclosure includes a cylinder block 200, a block water jacket 230, a cylinder liner 300, a cylinder head 400, and a block insert assembly 100.

The cylinder block 200 is a part constituting the skeleton of the engine, and the cylinder liner 300, the block water jacket 230, and the block insert assembly 100 are disposed therein. Then, one side of the cylinder block 200 is provided with a block coolant inlet 240 for communicating with a coolant passage 500 through which the coolant from a water pump not illustrated flows, and the other side thereof is provided with a block coolant outlet 250 out which the coolant having cooled the engine flows. Then, a coolant drill hole 220 for increasing the cooling efficiency is formed therein through the inter-bore 210 of the cylinder block 200 (see FIG. 4B).

The cylinder liner 300 is disposed inside the cylinder block 200, and is formed with a plurality of cylinder bores 310. A piston is disposed inside the cylinder bore 310, and the piston vertically reciprocates through the combustion of the fuel, thereby generating the power of the engine.

The block water jacket 230 is a space that is formed between the inner circumferential surface of the cylinder block 200 and the outer circumferential surface of the cylinder liner 300 to become a passage through which coolant flows. One side of the block water jacket 230 communicates with the block coolant inlet 240. Therefore, the coolant received through the block coolant inlet 240 from the water pump flows to the block water jacket 230. In addition, the other side of the block water jacket 230 communicates with the block coolant outlet 250. Therefore, the coolant having cooled the cylinder block 200 and the cylinder head 400 is discharged through the block coolant outlet 250 from the block water jacket 230.

The block insert assembly 100 is inserted into the lower portion of the block water jacket 230 to guide the flow of the coolant. The block insert assembly 100 according to the present disclosure is composed of a first block insert 110 disposed at the exhaust side of the cylinder block 200 and a second block insert 120 disposed at the intake side of the cylinder block 200 with the cylinder liner 300 interposed therebetween. The cylinder structure of the vehicle engine using the block insert assembly 100 will be described in detail later.

The cylinder head 400 is mounted on the cylinder block 200 with a gasket not illustrated interposed therebetween. The cylinder head 400 is mounted with an intake and exhaust valve for controlling the entry and exit of a mixer into the cylinder, an ignition plug for igniting the fuel, etc. Then, a head water jacket 410, which becomes a passage of the coolant flowing into the cylinder head 400, is formed inside the cylinder head 400. A head coolant inlet 420 of the head water jacket 410 is installed at the upper portion of the exhaust side of the block water jacket 230, and a head coolant outlet 430 is installed at the upper portion of the intake side of the block water jacket 230, thereby communicating with the block water jacket 230, respectively (see FIGS. 7A and 7B). Therefore, the head water jacket 410 receives coolant from the upper portion of the exhaust side of the block water jacket 230 from the head coolant inlet 420, and discharges the coolant to the upper portion of the intake side of the block water jacket 230 through the head coolant outlet 430.

FIGS. 1 to 5 are diagrams illustrating the block insert assembly 100 according to the present disclosure. Among them, FIG. 1 is a perspective diagram of the block insert assembly 100 according to the present disclosure.

As illustrated in FIG. 1, the block insert assembly 100 according to the present disclosure is composed of the first block insert 110 disposed at the exhaust side of the cylinder block 200 and the second block insert 120 disposed at the intake side of the cylinder block 200 with the cylinder liner 300 interposed therebetween. Considering workability, heat resistance, etc., the block insert assembly 100 may be made of a resin material. The first and second block inserts 110, 120 includes insert frames 115, 125 of the resin material becoming a main body, flow resistors 111, 121 mounted at the front end of the insert frames 115, 125 adjacent to the block coolant inlet 240 side, flow resistors 112, 122 mounted at the rear end of the insert frame adjacent to the block coolant outlet 250, horizontal rubber seals 113, 123, and vertical rubber seals 114, 124, respectively.

The insert frames 115, 125 become the main bodies of the first block insert 110 and the second block insert 120, respectively, and are formed in the form of lengthily extending from the front to the rear in the longitudinal direction of the cylinder block 200. The inside surfaces of the insert frames 115, 125 have a shape corresponding to the outer circumferential surface of the cylinder liner 300, and the outside surfaces of the insert frames 115, 125 have a shape corresponding to the inner circumferential surface of the cylinder block 200. Then, the height of the insert frames 115, 125 is lower than the height of the cylinder block 200.

As described above, a first flow resistor 111 for sealing only a partial space of the lower portion of the space between the cylinder block 200 and the cylinder liner 300 is provided at the front end of the insert frame 115 of the first block insert 110. Then, as illustrated in FIG. 1, the insert frame 115 of the first block insert 110 is provided with the inclined portion whose height reduces toward the front end thereof, and the first flow resistor 111 is provided at one end of the corresponding inclined portion. The first flow resistor 111 can be integrally made of the same material as the insert frame 115, and as illustrated in FIG. 1, can be made of a different material to be mounted on the insert frame 115. As described above, since the first flow resistor 111 seals only a partial space of the lower portion of the space between the cylinder block 200 and the cylinder liner 300, the coolant flowing into the upper space flows to the upper portion of the insert frame 115 along the inclined portion of the front end of the insert frame 115.

Meanwhile, a second flow resistor 121 for sealing the entire upper and lower spaces between the cylinder block 200 and the cylinder liner 300 is provided at the front end of the insert frame 115 of the second block insert 120. Therefore, the second flow resistor 121 of the second block insert 120 blocks the coolant flowing into the cylinder block 200 through the block coolant inlet 240 from directly flowing into the intake side block water jacket 230.

A third flow resistor 112 for sealing the entire upper and lower spaces between the cylinder block 200 and the cylinder liner 300 is provided at the rear end of the insert frame 115 of the first block insert 110. Therefore, the coolant flowing through the block water jacket 230 of the exhaust side thereof is prevented from directly flowing into the block coolant outlet 250.

A fourth flow resistor 122 for sealing only a partial space of the lower portion of the space between the cylinder block 200 and the cylinder liner 300 is provided at the rear end of the insert frame 115 of the second block insert 120. In one form, the insert frame 115 of the second block insert 120 is provided with an inclined portion whose height reduces toward the rear end thereof as illustrated in FIG. 1, and the fourth flow resistor 122 is provided at one end of the corresponding inclined portion. Since the fourth flow resistor 122 seals only a partial space of the lower portion of the space between the cylinder block 200 and the cylinder liner 300, the coolant is discharged to the outside through the block coolant outlet 250 along the inclined portion of the rear end of the insert frame 115 of the second block insert 120.

Meanwhile, since the block insert is lower than the height of the inner space of the cylinder block, the second flow resistor 121 and the third flow resistor 112 have protrusion portions 121*a*, 112*a* protruding upwardly from the insert frame 115 in order to block the flow of coolant more reliably by the second flow resistor 121 and the third flow resistor 112. Alternatively, the second flow resistor 121 and the third flow resistor 112 can be configured so that a part of the rear end of the insert frame 115 of the first block insert 110 and a part of the front end of the insert frame 115 of the second block insert 120 are protruded therefrom.

Figure 2:
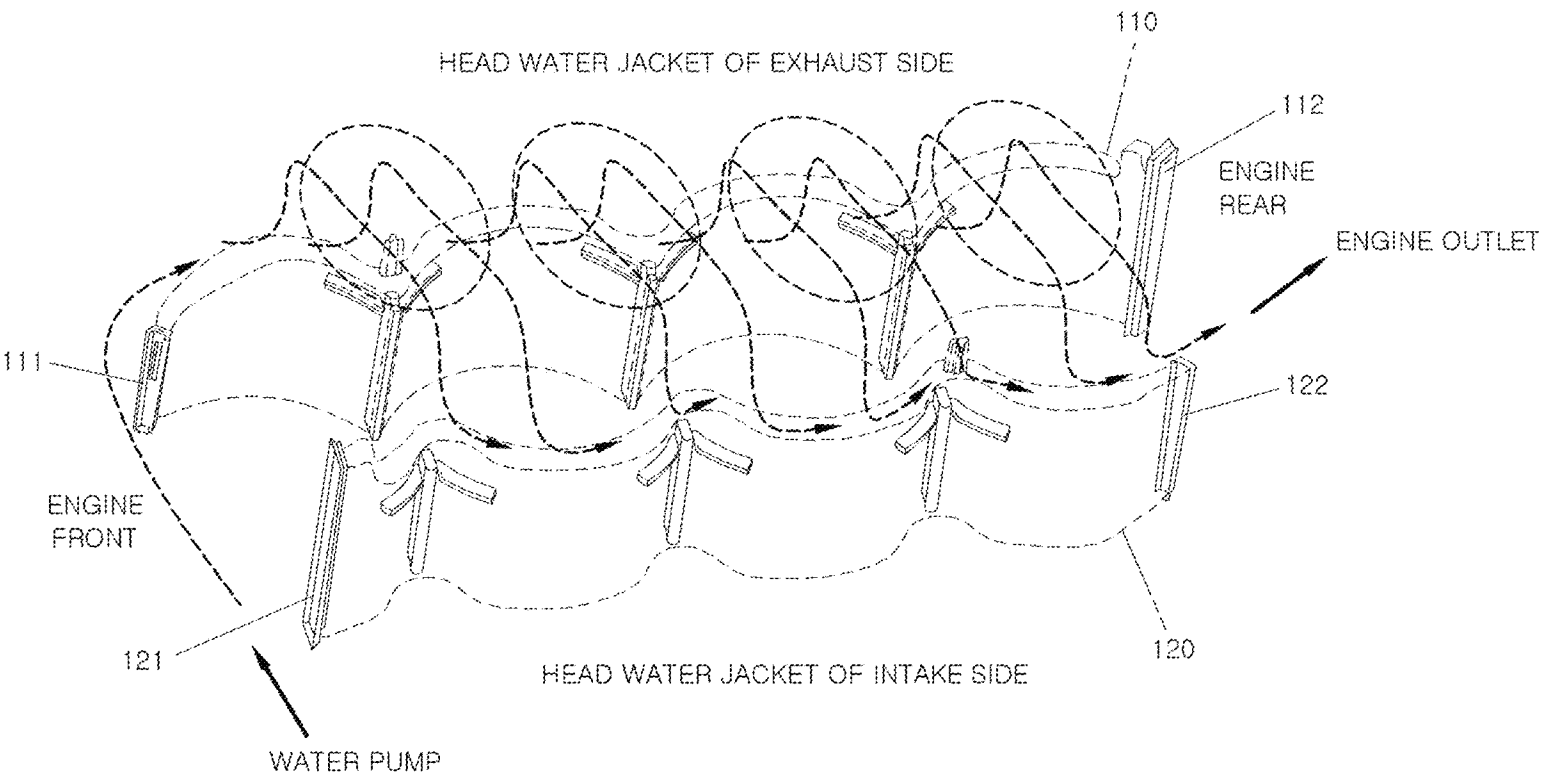
FIG. 2 is a diagram illustrating the cross-flow of coolant when the block insert assembly is applied.

FIG. 2 is a diagram illustrating the cross-flow of coolant when the block insert of FIG. 1 is applied to the cylinder structure of the engine. Then, FIG. 7A is a cross-sectional diagram taken along the line a-a of FIG. 6. FIG. 7B is a cross-sectional diagram taken along the line b-b of FIG. 6.

When the coolant flows into the block water jacket 230 from the water pump through the block coolant inlet 240, the space through which the coolant can directly flow into the block water jacket 230 at the intake side thereof has been blocked by the second flow resistor, such that the inflowing coolant flows to the upper portion of the first block insert 110 by the first flow resistor 111. Then, the coolant quickly cools the upper portion of the cylinder block 200 of the intake side thereof while flowing along the engine rear side from the engine front along the upper portion of the insert frame 115 of the first block insert 110. Meanwhile, the flow of the coolant is blocked by the third flow resistor 112 of the first block insert 110 so that the coolant no longer proceeds toward the engine rear side, and the whole amount of the coolant is evenly supplied to the head water jacket 410 of the cylinder head 400 through the head coolant inlet 420. Although the coolant supplied to the head water jacket 410 is determined according to the size, the shape, the number, and the position of the head coolant inlet 420, the size, etc. are usually adjusted in order to flow the same flow rate in the first to fourth cylinders.

Figure 7B:
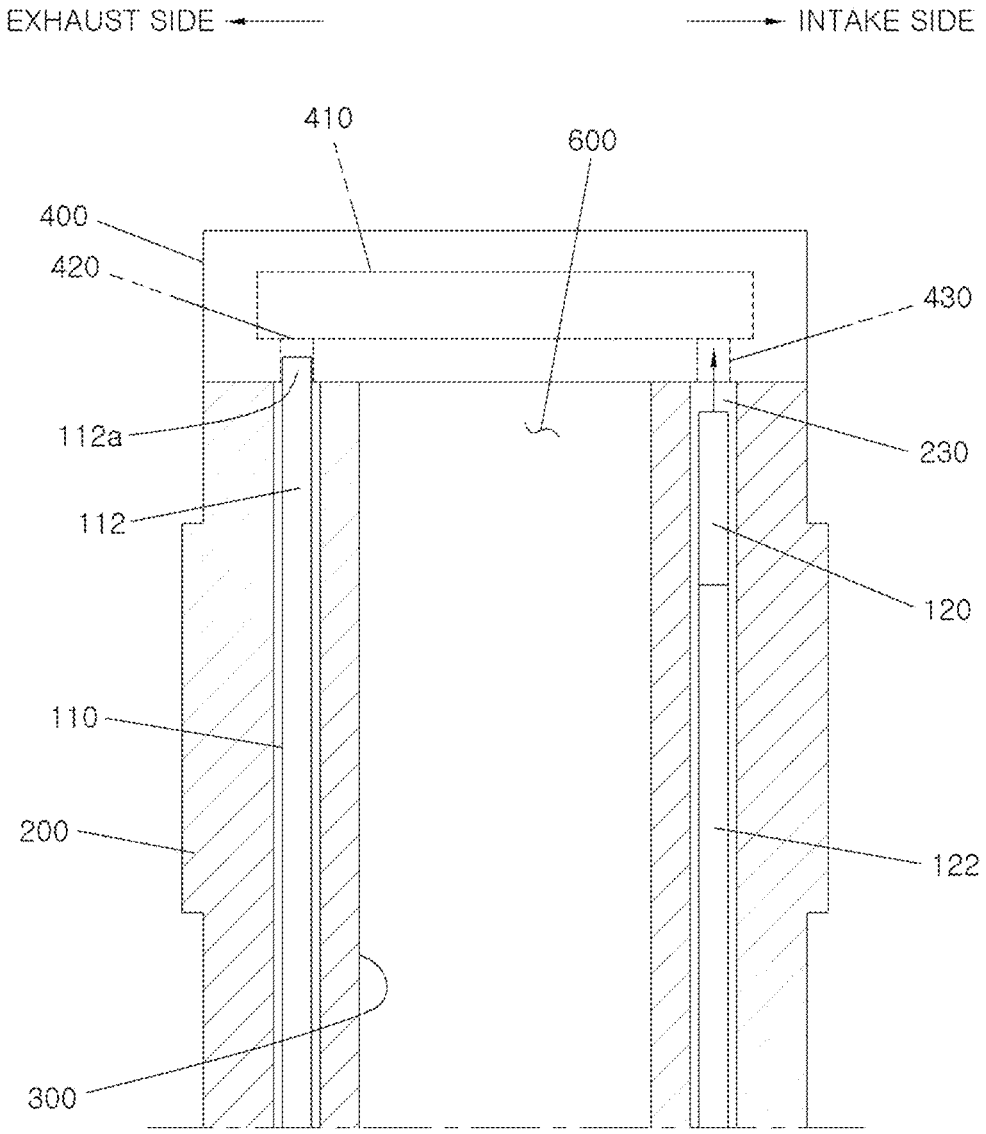
FIG. 7B is a cross-sectional diagram taken along the line b-b of FIG. 6.

As illustrated in FIG. 7B, the coolant thus supplied to the head water jacket 410 of the cylinder head 400 flows perpendicular to the front-rear direction of the engine, that is, toward the upper portion side of the second block insert 120 of the exhaust side thereof while keeping the cross-flow. Then, the coolant is supplied to the block water jacket 230 of the upper portion of the second block insert 120 of the exhaust side thereof through the head coolant outlet 430. The coolant supplied to the upper portion of the second block insert 120 of the exhaust side thereof through the head coolant outlet 430 quickly cools the upper portion of the cylinder block 200 of the intake side thereof while flowing along the engine rear side from the engine front along the upper portion of the insert frame 115 of the second block insert 120.

Then, as illustrated in FIG. 7B, since the fourth flow resistor 122 seals only a partial space of the lower portion of the space between the cylinder block 200 and the cylinder liner 300, the coolant having reached the rear end of the second block insert 120 is discharged to the outside through the block coolant outlet 250 along the inclined portion of the rear end of the insert frame 115 of the second block insert 120.

As described above, it is possible only to mount the block insert assembly 100 according to the present disclosure in the block water jacket 230, thereby easily forming the cross-flow of the coolant even without forming a separate coolant chamber for generating the cross-flow.

As illustrated in FIG. 1, the inside surface of at least any one of the first block insert 110 or the second block insert 120 of the block insert 100 in one form of the present disclosure is provided with at least one vertical rubber seal 124 that is a flow resistor in the vertically extending and protruding shape.

In another form, the vertical rubber seal 124 is disposed at a position corresponding to the inter-bore 210 of the cylinder block 200.

Figure 3:
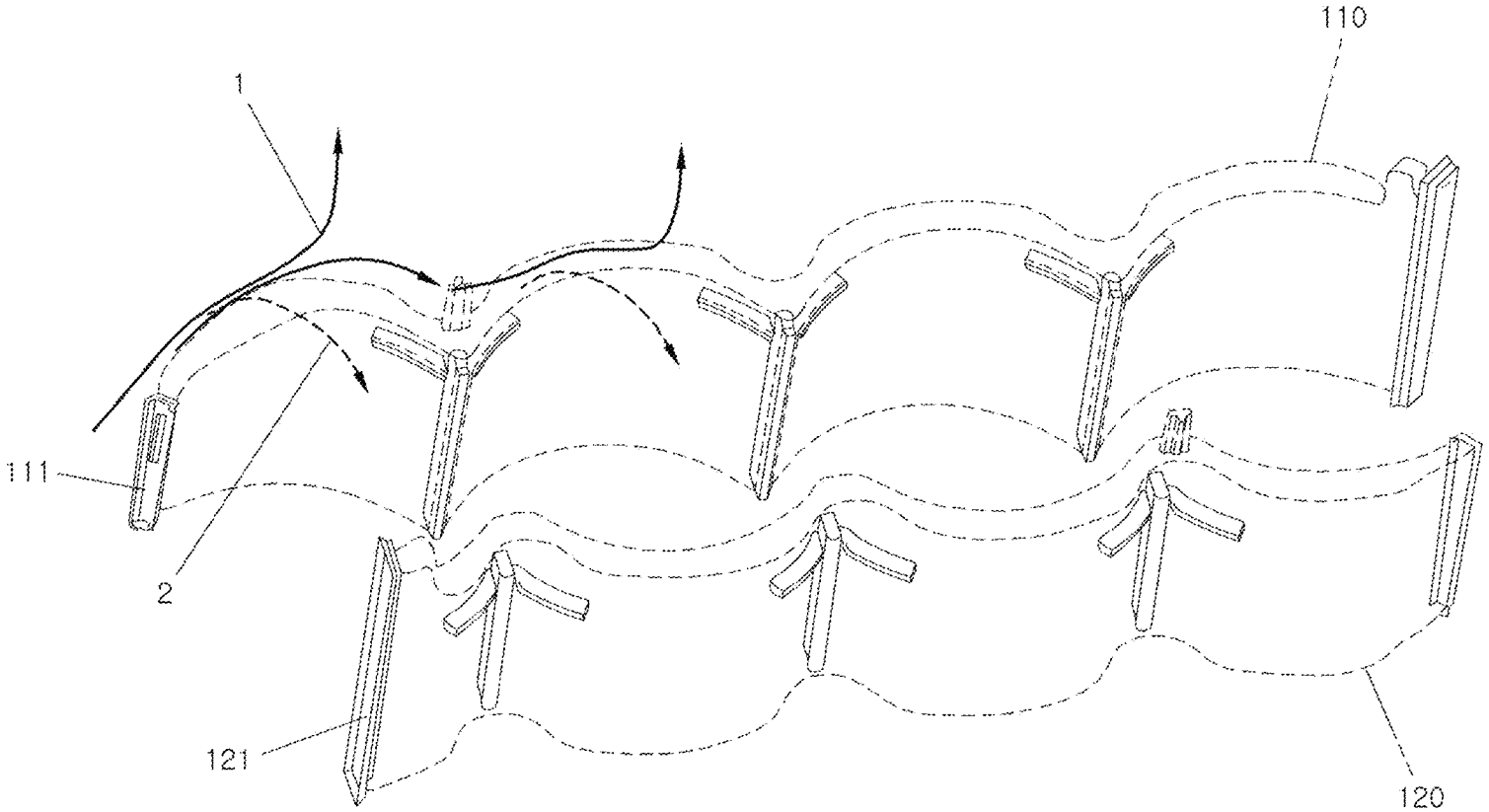
FIG. 3 is a diagram illustrating the influence of a vertical rubber seal provided in the block insert assembly on the flow of the coolant.

FIG. 3 is a diagram illustrating the influence of the vertical rubber seal 124 provided in the block insert 100 on the flow of the coolant in one form of the present disclosure.

As described above, a part of the coolant flowing through the upper portion of the first block insert 110 flows in the direction 1 toward the cylinder head 400 and a part thereof flows in the horizontal direction 2. In addition, although not illustrated in FIG. 3, the coolant received from the head water jacket 410 of the cylinder head 400 flows in the horizontal direction even at the upper portion of the second block insert 120. A part of the flow of the coolant in the horizontal direction 2 flows downwardly 3 toward the space between the block insert assembly 100 and the cylinder liner 300. In one form of the present disclosure, the vertical rubber seal 124 is provided on the inside surface of the block insert assembly 100, such that the flow of the coolant flowing downwardly 2 is obstructed by the vertical rubber seal 124, thereby reducing the flow rate of the coolant, and occurring the energy loss. Therefore, the coolant stagnates locally in the middle and lower portion of the cylinder block 200. Therefore, the coolant flowing downwardly 2 is moved back to the upper portion thereof, thereby strengthening the flow rate of the coolant at the upper portion of the cylinder block 200, while the coolant stagnates in the middle and lower portion thereof.

As described above, when the coolant stagnates in the middle and lower portion of the cylinder block 200, the water temperature of the coolant increases due to the heat transfer from the cylinder liner 300. As a result, the temperature increases (warm block) in the middle and lower portion of the cylinder block 200, thereby reducing the loss due to the friction of the piston. Therefore, the fuel efficiency increases. Meanwhile, the coolant excessively overheated exchanges heat with the coolant of the upper portion thereof by the convection, thereby preventing the boiling of the coolant.

That is, according to the present disclosure, it is possible to efficiently implement the stagnation of the coolant at the lower portion of the cylinder block 200, thereby reducing the loss due to the friction of the piston to increase the fuel efficiency, while it is possible for the coolant of the upper portion and the lower portion thereof to exchange heat therebetween even in the excessive overheating, thereby constantly keeping the water amount of the coolant and implementing a stable system.

As illustrated in FIG. 1, the inside surface of at least any one of the first block insert 110 or the second block insert 120 of the block insert 100 according to one form of the present disclosure is provided with at least one horizontal rubber seal 123 that is a flow resistor in the horizontally extending and protruding shape.

Figure 4A:
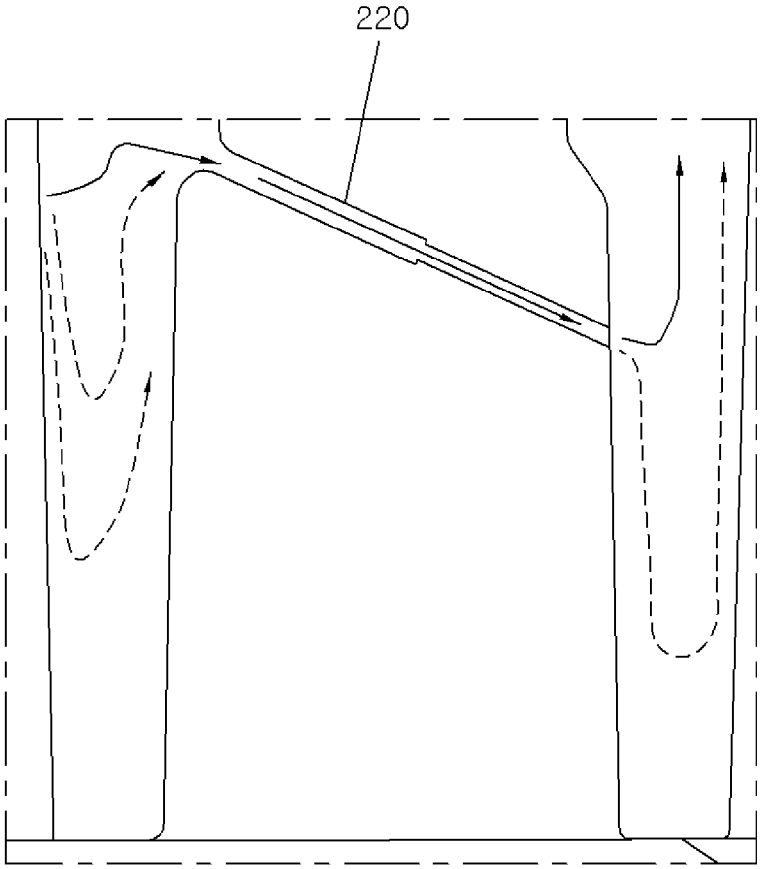
FIG. 4A is a diagram illustrating the flow of the coolant near both end portions of a coolant drill hole that passes through an inter-bore of a conventional cylinder block.

A portion having the highest temperature in the cylinder block 200 is the inter-bore 210 between the cylinder and the cylinder. The left and right portions of the inter-bore 210 are easily cooled by the coolant flowing through the block water jacket 230, but the cooling of the inter-bore 210 itself is not easy. Therefore, in order to cool the inter-bore 210, the coolant drill hole 220 passing through the inter-bore 210 is usually formed in the inter-bore 210 so that the inter-bore 210 is cooled. However, as illustrated in FIG. 4A, since the coolant drill hole 220 is inclined from the upper portion to the lower portion thereof, the coolant flowing into the coolant drill hole 220 permeates toward the lower portion of the cylinder block 200, thereby easily cooling the lower portion of the cylinder block 200. In this case, the temperature of the lower portion of the cylinder block 200 is reduced, thereby increasing the friction of the piston to reduce the fuel efficiency.

Figure 4B:
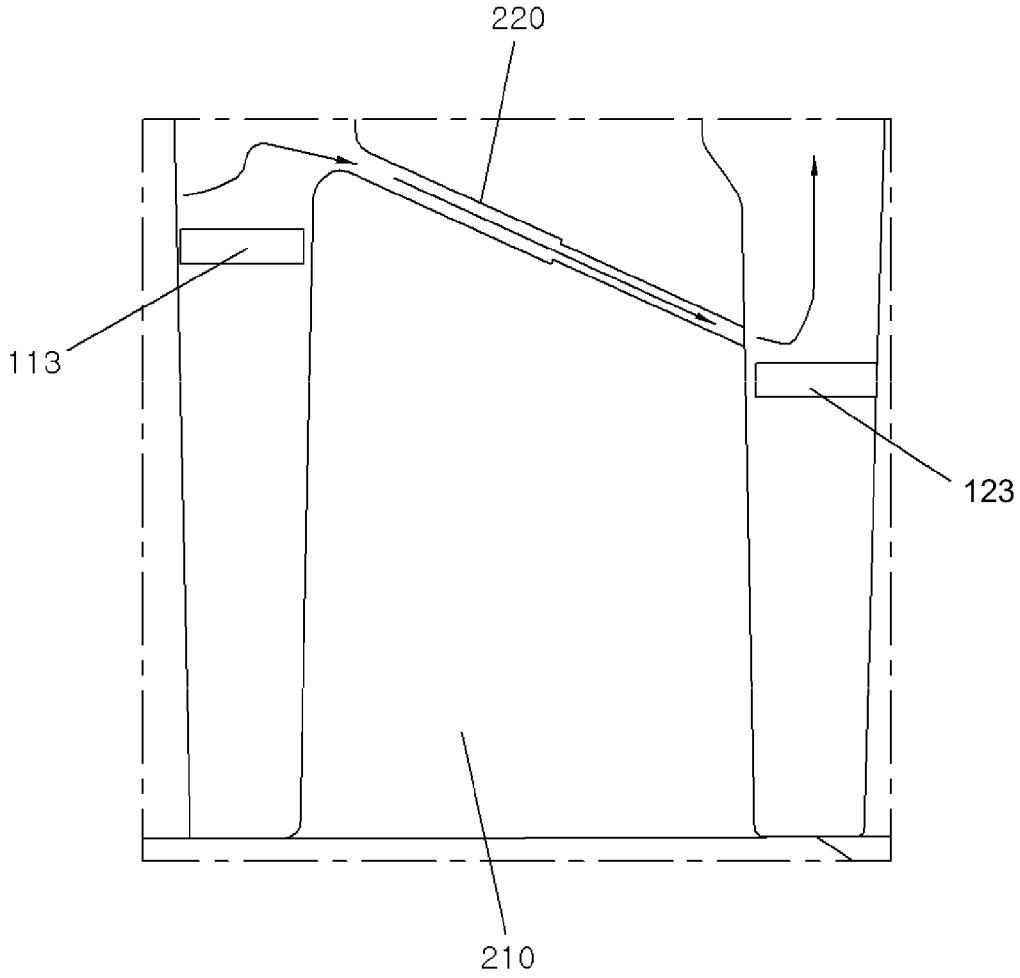
FIG. 4B is a diagram illustrating the flow of the coolant near both end portions of the coolant drill hole that passes through the inter-bore of the cylinder block when the block insert assembly according to the present disclosure is applied.

However, in the present disclosure, the inside surface of the block insert 100 is provided with the horizontal rubber seal 123, thereby suppressing the coolant flowing out from the coolant drill hole 220 from flowing to the lower portion of the cylinder block 200, as illustrated in FIG. 4B. Therefore, it is possible to suppress the middle and lower portion of the cylinder block 200 from being easily cooled. In addition, the coolant, which has been blocked from flowing downwardly by the horizontal rubber seal 123, is moved back to the upper portion thereof, thereby facilitating the cooling of the upper portion of the cylinder block 200.

In order to exert the effects, the horizontal rubber seal 123 is disposed below the lower end of the coolant drill hole 220.

Figure 5:
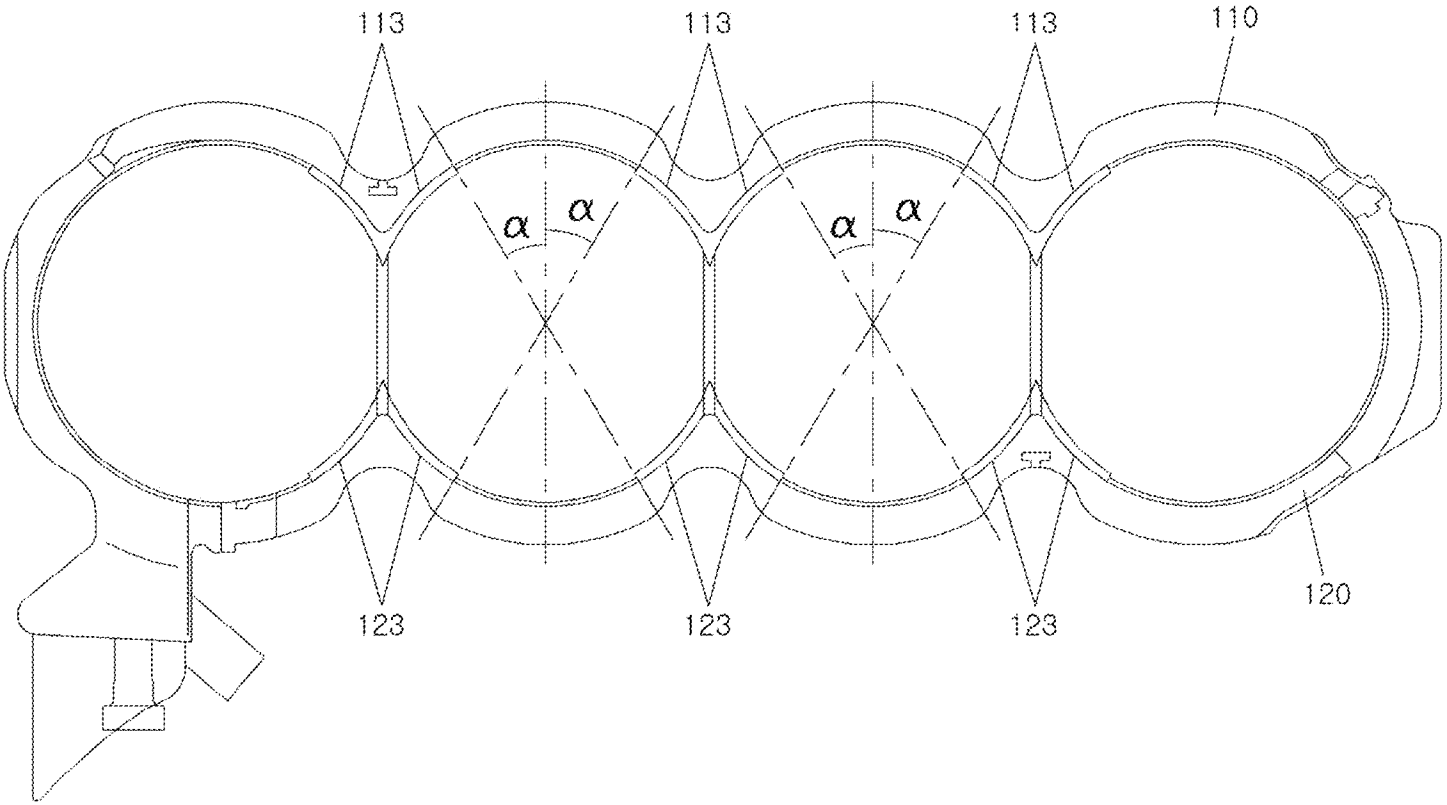
FIG. 5 is a diagram illustrating the mounting range of a horizontal rubber seal of the block insert assembly according to one form of the present disclosure.

In addition, as illustrated in FIG. 5, the horizontal rubber seal 123 is configured to extend within a predetermined angle range a (e.g., 20 to 30°) from the left to the right based on a position corresponding to the inter-bore 210 of the cylinder block 200 when viewed from the upper surface thereof. A preferred angle can be obtained experimentally according to the characteristic of the engine.

Figure 8:
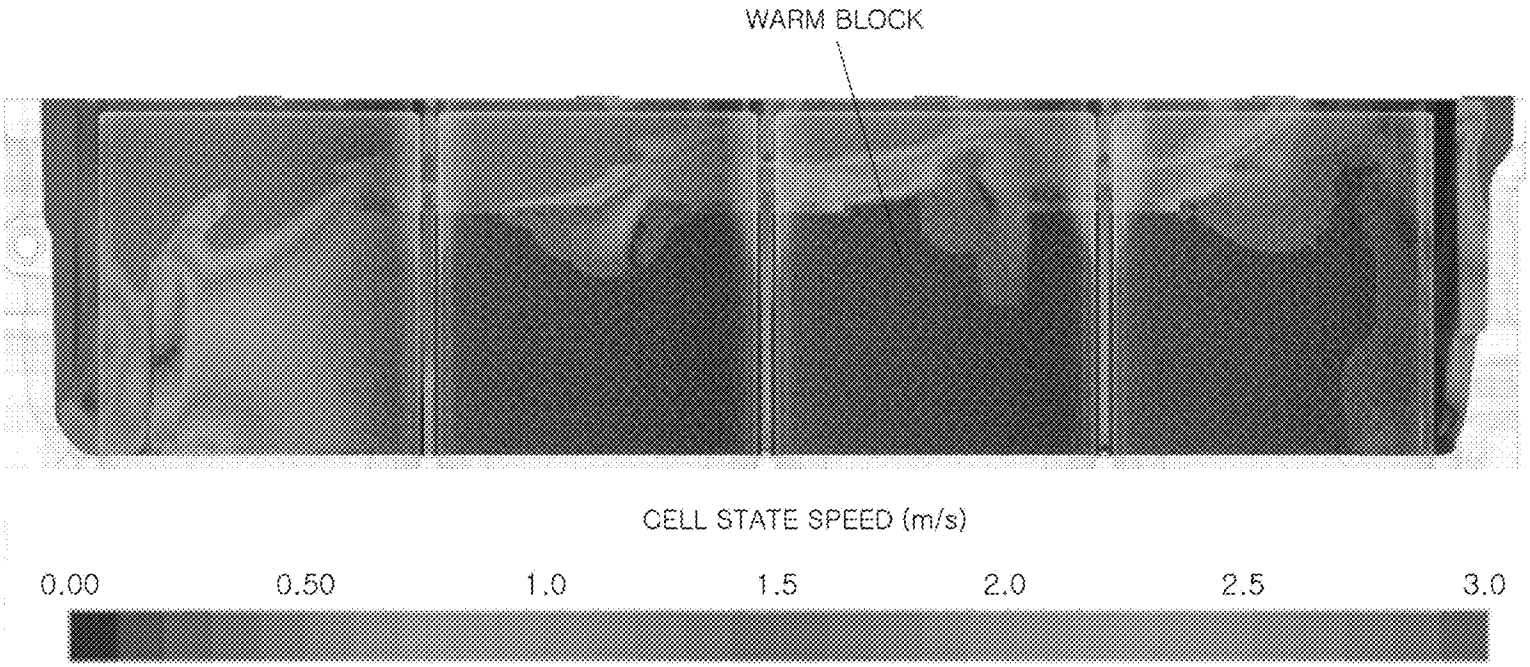
FIG. 8 is a diagram illustrating the flow of the coolant in a cylinder block 200 in a vehicle in which the cylinder structure of the engine according to one form of the present disclosure is adopted.

FIG. 8 is a diagram illustrating the flow of the coolant in the cylinder block 200 in a vehicle in which the cylinder structure of the engine according to the present disclosure is adopted.

As illustrated in FIG. 8, it can be seen that the flow rate of the coolant is low at the lower portion of the cylinder block 200 where the warm block is formed by the block insert assembly 100, thereby efficiently stagnating the coolant. As a result, the temperature of the cylinder liner 300 at the lower portion of the cylinder block 200 increases by 15 to 20° C. or more according to the region thereof, thereby excellently reducing the friction of the piston as compared with the related art.

In addition, the flow rate of the coolant has been increased at the upper portion of the cylinder block 200, thereby reducing the temperature at the upper portion of the cylinder block 200. Therefore, the knocking characteristic has been improved, thereby improving the output and the fuel efficiency in the low-medium-speed and high-load region.

What is claimed is:

1. A block insert assembly for a block water jacket for an engine, wherein the block water jacket is formed between a cylinder block and a cylinder liner, the block insert assembly comprising:

a first block insert, and a second block insert, which are arranged between the cylinder liner and the cylinder block, wherein a first side end portion of the first block insert, which is adjacent to a block coolant inlet side, has a first flow resistor configured to seal a partial space of a space between the cylinder block and the cylinder liner, wherein a first side end portion of the second block insert, which is adjacent to the block coolant inlet side, has a second flow resistor configured to seal an entire space between the cylinder block and the cylinder liner, and wherein the first side end portion of the first block insert is configured to be inclined from an upper portion to a lower portion of an insert frame that is a main body.

2. The block insert assembly of claim 1, wherein a second side end portion of the first block insert has a third flow resistor configured to seal the entire space between the cylinder block and the cylinder liner, and wherein a second side end portion of the second block insert has a fourth flow resistor configured to seal a partial space of a lower portion of the space between the cylinder block and the cylinder liner.

3. The block insert assembly of claim 2, wherein the second side end portion of the second block insert is configured to be inclined from the upper portion to the lower portion of the insert frame.

4. The block insert assembly of claim 2, wherein the first and second flow resistors provided at the second side end portion of the first block insert and the first side end portion of the second block insert are protruded upwardly from the insert frame that is the main body of the block insert assembly, respectively.

5. The block insert assembly of claim 1, wherein the block insert assembly is made of a resin material.

6. The block insert assembly of claim 1, wherein an inside surface of at least one of the first block insert or the second block insert is provided with at least one vertical rubber seal that is a flow resistor in a vertically extending and protruding shape.

7. The block insert assembly of claim 6, wherein the vertical rubber seal is disposed at a position corresponding to an inter-bore of the cylinder block.

8. The block insert assembly of claim 1, wherein an inside surface of at least one of the first block insert or the second block insert is provided with at least one horizontal rubber seal that is a flow resistor in a horizontally extending and protruding shape.

9. The block insert assembly of claim 8, wherein the at least one horizontal rubber seal extends within a predetermined angle range from a left to a right based on a position corresponding to an inter-bore of the cylinder block when viewed from an upper surface thereof.

10. An engine structure of a vehicle, comprising:

a cylinder block including:

a block coolant inlet through which coolant flows in, and a block coolant outlet through which the coolant flows out;

a cylinder liner arranged inside of the cylinder block, and formed with a plurality of cylinder bores;

a block water jacket formed between an inner circumferential surface of the cylinder block and an outer circumferential surface of the cylinder liner, the coolant configured to flow along the block water jacket;

a block insert assembly inserted into the block water jacket and configured to guide the flow of the coolant in the block water jacket; and a cylinder head provided with a head water jacket receiving the coolant flowing through the block water jacket, wherein the block insert assembly comprises:

a first block insert disposed on an exhaust side of the cylinder block and inserted between the cylinder liner and the cylinder block, and a second block insert disposed on an intake side of the cylinder block and inserted between the cylinder liner and the cylinder block, wherein a first side end portion of the first block insert, which is adjacent to the block coolant inlet side, has a first flow resistor for sealing only a partial space of a lower portion of a space between the cylinder block and the cylinder liner, and a first side end portion of the second block insert, which is adjacent to the block coolant inlet side, has a second flow resistor for sealing an entire space between the cylinder block and the cylinder liner, such that a part of the coolant received from the block coolant inlet is guided to the head water jacket along an upper surface of the first flow resistor, and a part of the coolant received from the block coolant inlet is prevented, by the second flow resistor, from directly flowing into the block water jacket of a side on which the second block insert is installed, and wherein the first side end portion of the first block insert is configured to be inclined from an upper portion to a lower portion of an insert frame that is a main body.

11. The engine structure of the vehicle engine of claim 10, wherein a second side end portion of the first block insert has a third flow resistor for sealing the entire space between the cylinder block and the cylinder liner, and wherein a second side end portion of the second block insert has a fourth flow resistor for sealing only a partial space of the lower portion of the space between the cylinder block and the cylinder liner, such that the coolant is prevented, by the third flow resistor, from being directly discharged to the block coolant outlet from the second side end portion of the first block insert, and the coolant is guided to the block coolant outlet along an upper surface of the fourth flow resistor.

12. The engine structure of the vehicle engine of claim 10, wherein an inside surface of at least one of the first block insert or the second block insert is provided with at least one vertical rubber seal that is a flow resistor in a vertically extending and protruding shape.

13. The engine structure of the vehicle engine of claim 12, wherein the vertical rubber seal is disposed at a position corresponding to an inter-bore of the cylinder block.

14. The engine structure of the vehicle engine of claim 10, wherein an inside surface of at least one of the first block insert or the second block insert is provided with at least one horizontal rubber seal that is a flow resistor in a horizontally extending and protruding shape.

15. The engine structure of the vehicle engine of claim 14, wherein a coolant drill hole that passes through an inter-bore of the cylinder block and obliquely extends downwardly from an upper portion of the cylinder block is formed in the cylinder block, and wherein the horizontal rubber seal is disposed at a lower portion of both end portions of the coolant drill hole.

16. The engine structure of the vehicle engine of claim 15, wherein the horizontal rubber seal extends within a predetermined angle range from a left to a right based on a position corresponding to the inter-bore of the cylinder block.

* * * * *